United States Patent [19]

Fontaine et al.

[11] Patent Number: 4,702,674

[45] Date of Patent: Oct. 27, 1987

[54] METHOD OF ACCURATELY SETTING THE FLOW RATE OF A VARIABLE-FLOW METERING PUMP, AND A METERING PUMP EMPLOYING THE METHOD

[75] Inventors: Guy R. Fontaine, Paris; Max A. Malizard, St. Rémy l'Honoré; Bernard R. Demouron, Senlis, all of France

[73] Assignee: Dosapro Milton Roy, Pont-Saint-Pierre, France

[21] Appl. No.: 913,202

[22] Filed: Sep. 29, 1986

[30] Foreign Application Priority Data

Oct. 4, 1985 [FR] France ..... 85 14733

[51] Int. Cl.[4] ..... F04B 49/06; B67D 5/30; G04C 5/08

[52] U.S. Cl. ..... 417/44; 417/415; 222/14; 222/61; 222/642

[58] Field of Search ..... 417/12, 44, 45, 415; 73/864.16; 222/14, 333, 61, 642

[56] References Cited

U.S. PATENT DOCUMENTS

| | | | |
|---|---|---|---|
| 3,915,651 | 10/1975 | Nishi | 417/12 |
| 4,321,014 | 3/1982 | Eburn | 417/53 |
| 4,475,666 | 10/1984 | Bilbrey et al. | 73/864.16 |
| 4,572,405 | 2/1986 | Miura | 222/642 |
| 4,633,413 | 12/1986 | Iauqney et al. | 73/864.16 |

OTHER PUBLICATIONS

Micropump published by the Review of Scientific Instruments, vol. 43, No. 9 (Sep. 1972).

*Primary Examiner*—William L. Freeh

*Attorney, Agent, or Firm*—Woodcock Washburn Kurtz Mackiewicz & Norris

[57] ABSTRACT

A pump in accordance with the invention has moving equipment (32) driven by a reversible synchronous motor (42) whose windings (44, 45) are connected to a power source by means of optocoupled triacs (48, 49) which, under microprocessor control, are used to adjust the flow rate of the pump by acting on its admission period (by powering the windings in one direction) and on the pumping cycle time (by varying the period for which the pump is unpowered in each cycle).

10 Claims, 2 Drawing Figures

METHOD OF ACCURATELY SETTING THE FLOW RATE OF A VARIABLE-FLOW METERING PUMP, AND A METERING PUMP EMPLOYING THE METHOD

A "metering" pump delivers an accurately determined quantity of pumped fluid, and a variable-flow metering pump may have its flow rate varied under manual control, either directly or indirectly via a servomotor, or else by applying a suitable electric or pneumatic control signal thereto.

BACKGROUND OF THE INVENTION

In most prior systems the flow rate is varied either by acting on the operating speed (i.e. the number of pump cycles per unit time) while keeping the fluid flow rate per pump cycle constant, or by varying the fluid flow rate per cycle while keeping the operating speed constant. More rarely, the flow rate is adjusted by acting in combined manner both on the operating speed and on the flow rate per cycle, as is the case for electromagnetic pumps in which timing circuits act both on the frequency of electromagnet excitation periods and also on the stroke of the electromagnet. Such systems require two data inputs to the pump, i.e. two manual controls or two distinct signal inputs.

The invention is directed more particularly to such known pumps in which a fluid is caused to flow as the result of reciprocating motion of a piston or of cyclical deformation of a mechanically-actuated membrane.

When the pumping member is a piston, the volumetric displacement of the pump is exactly proportional to the stroke of the piston and the resulting flow rate is proportional to said stroke and to the pumping speed. When the pumping member is a mechanically-actuated membrane, a non-linear relationship exists between the volume swept by the membrane and the displacement of the membrane-actuating member which is connected to the center of the membrane. This relationship is complex and depends, in particular, on the manner in which the actuator member is connected to the membrane, on the physical nature of the membrane, on the shape of the membrane seating surfaces, and also on the operating speed. The relationship is generally determined experimentally.

In pumps of the type to which the invention applies, the means for adjusting the volumetric displacement are generally situated in the members for transmitting motor drive to the piston or the membrane actuator, and such means considerably complicate the transmission and make it difficult to transmit forces properly. In addition, if such means are operated automatically it is necessary to supply a non-negligible quantity of power to operate them, and as a result the equipment is expensive and its flexibility in use is reduced relative to devices which can be controlled by small currents using cheap components.

The present invention is the result of researoh into means for making it possible to construct a simple variable-flow metering pump using commonly-available components as much as possible, while still obtaining flow rates which can be adjusted with an error of less than one percent. The present invention provides a method of setting a determined flow rate which enables the metering pump to be driven by a synchronous motor which is itself powered by AC at a fixed frequency, which includes an extremely simple transmission mechanism without any need for a drive-varying device, and which uses an electronic control circuit associated with a microprocessor to provide highly flexible operation at low cost, where all of the above factors are highly advantageous in providing such a variable flow metering pump at low cost. The invention also provides a pump which implements the method.

SUMMARY OF THE INVENTION

In a first aspect, the present invention provides a method of accurately setting the flow rate of a variable-flow metering pump, said setting being expressed as a fraction of the pump's maximum flow rate, and said pump including a pumping member coupled to a transmission element driven with a rectilinear reciprocating motion and creating a direct and positive link between said pumping member and a reversible synchronous electric motor which is powered by AC at fixed frequency.

According to one of the main characteristics of the invention the method consists in using a microprocessor to control the power supply to the drive motor for each pump cycle in accordance with the following steps:

a first step in which the power is applied to the motor to rotate it in a first direction and in which said power is maintained for a first period of time determined from a fixed predetermined origin position of the moving equipment in the pump;

a second step in which the power applied to the motor at the end of said first period of time is switched to reverse the direction in which the motor rotates, and in which said reverse power is maintained for a period of time equal to that required by the moving equipment of the pump to return to its origin position;

a third step in which the power supply to the motor is turned off at the end of said second period of time and in which the power is maintained off for a third period of time corresponding to the difference between the sum of said first and second periods of time and a pumping cycle time which is not less than said sum;

said first period of time and said cycle time being selected by the microprocessor as a function of the desired fraction of the maximum flow rate as indicated to the microprocessor, and being selected from a plurality of time values stored in the microprocessor memory and each equal to an integer multiple of one half of the period of the AC power supply.

If the pumping member is a piston driven with sinusoidal motion, the values stored in memory for said first period of time and said cycle time are determined by calculation.

In contrast, if the flow rate of the pump is a complex function of the motion of the drive motor, by virtue of the nature of the drive chain connecting the motor to the pumping member and of the nature of the pumping member if it is a membrane, the said values stored in the microprocessor memory are determined experimentally.

Finally, it is advantageous for the origin position of the pump's moving equipment to be detected and controlled by means of at least one sensor whose output signal is made use of by the microprocessor.

In a second aspect the invention provides a pump applying the above method and comprising: a pumping member; moving equipment for driving said pumping member; said moving equipment being driven to perform reciprocating rectilinear motion by means of a transmission device coupled to a motor, said motor being a reversible synchronous motor with each of its windings connected to a source of AC power at fixed frequency via a triac which is optocoupled to a controlling light emitting diode (LED) which is itself connected to the output from a microprocessor for controlling the application of AC power to said windings, and a detector for detecting when said moving equipment is in its origin position, said detector being connected to an input of said microprocessor.

BRIEF DESCRIPTION OF THE DRAWINGS

Embodiments of the invention are described by way of example with reference to the accompanying drawings, in which.

MORE DETAILED DESCRIPTION

Figure 1:
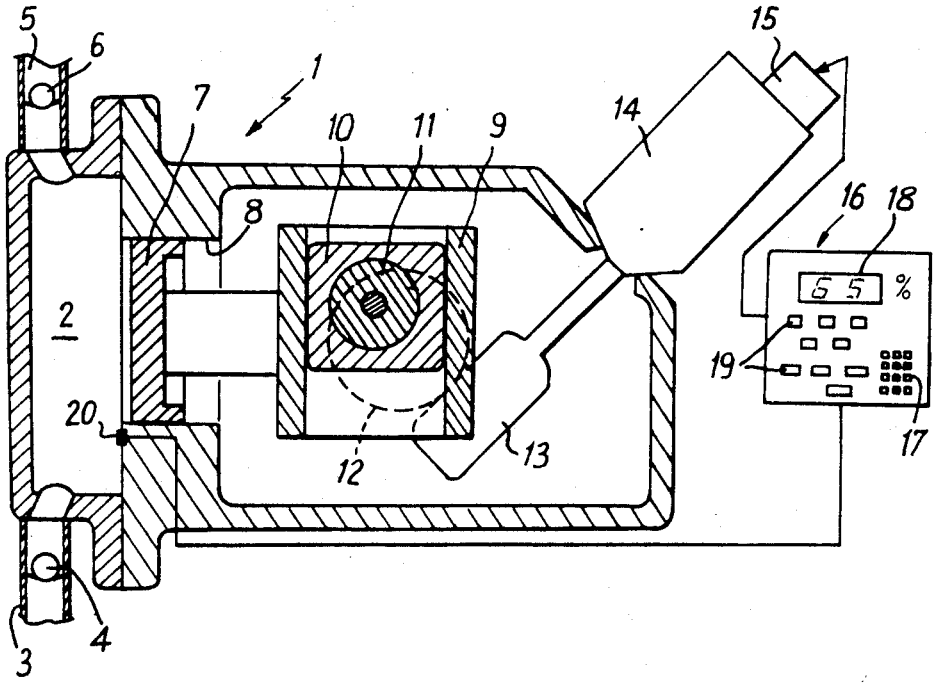
FIG. 1 is a diagram in partial section through a pump implementing the method of the invention, in which the pumping member is a piston driven in sinusoidally-reciprocating rectilinear motion.

Reference is made initially to FIG. 1 which is a highly diagrammatic section through a piston metering pump comprising the following components:

a pump chamber 2 connected to an inlet duct 3 via a non-return valve 4 and to an outlet duct 5 via a non-return valve 6;

a piston 7 which constitutes a moving wall of the chamber 5 and which is driven in reciprocating rectilinear motion along a slideway 8 in the body of the pump;

a transmission device coupled to the piston 7 and comprising a frame 9 in which a shoe 10 is capable of sliding transversely to the motion of the piston 7, the shoe being coupled to an eccentric cam 11 on a gear wheel 12 which meshes with an endless screw 13;

a synchronous motor 14 capable of rotating in two opposite directions and having an outlet shaft coupled to the endless screw 13;

an electronic control circuit 15 for switching on, for stopping, and for reversing the motor 14;

a microprocessor 16 for controlling the circuit 15 and including a keypad 17 which may be used to cause the flow rate which the pump is to deliver (expressed as a fraction of the maximum pump flow rate) to be displayed at 18, and keys 19 for selecting or rejecting particular control sub programs used for correcting an overall pump operation control program as a function, for example, of the nature of the fluid to be metered; and a sensor 20 having its output connected to said microprocessor, said sensor detecting the presence of the piston 7 at its forward dead-center position which is taken by the microprocessor to be the origin position in which the moving equipment is to be found at the beginning of a pumping cycle.

The maximum pump flow rate is obtained when the stroke of the piston is equal to twice the eccentricity and when the pump is operating at maximum speed. For example, assume that the synchronous motor 14 has 16 poles and is powered by AC at a fixed frequency equal to a mains frequency of 50 Hz.

Also assume that the transmission ratio between the endless screw 13 and the gear wheel 12 is $\frac{1}{4}$. Thus, in operation the motor 14 rotates at 375 revolutions per minute (rpm) and the gear wheel 12 rotates at 93.75 rpm. The time taken to sweep through the maximum volumetric displacement is thus 640 milliseconds.

One of the possible ways of varying the pump flow rate is to act on the frequency of the AC powering the synchronous motor. Such a solution would require means for varying the frequency of an AC power supply and has been avoided for reasons of cost and reliability.

A second way lies in limiting the piston stroke for a given pumping cycle. The synchronous motor 14, together with the electronic control circuit 15 which is essentially constituted by on/off switches and reversing switches in the power supply circuit to the motor, are particularly suitable for this purpose. Thus, starting from a maximum flow rate with a cycle time of 640 milliseconds it can be seen that the admission stroke takes 320 milliseconds and that the exhaust stroke also takes 320 milliseconds. By powering the motor 14 for a shorter period of time than 320 milliseconds and then reversing the power supply at the end of said first period of time and maintaining the reverse power supply until the sensor 20 detects that the piston has returned to its origin position, the volume swept in the pump chamber is less than the volume swept by the piston when performing a maximum stroke. The motor is then kept switched off until the entire cycle time has elapsed, i.e. until the full 640 milliseconds are up.

It is thus possible, in theory, to obtain any desired fraction of the maximum pump flow rate by computing the admission stroke time which corresponds to the desired flow rate and by switching the motor on in the admission direction for that length of time.

However, when the windings of a reversible synchronous motor are controlled by means of triacs, as is described below with reference to FIG. 2, the operating characteristics of these components add a degree of inherent inaccuracy to the length of time the motor is switched on. The range of error is from zero to one-half period of the power supply circuit, i.e. anything up to 10 milliseconds for a power supply at 50 Hz. A triac becomes conductive as soon as it receives a switch-on signal, but it does not cease to conduct immediately after its control signal is switched off, but continues to conduct until the next zero crossing of the alternating voltage which it is being used to switch. In order to escape from this inaccuracy, it is advantageous to detect the voltage zero crossings in order either to inform the microprocessor of the moments at which said zero crossings occur so as to synchronize the application of control signals to the triac with the power supply voltage zero crossings, or else to gate the control signal so that the triac is only effectively triggered at a zero crossing in the power supply voltage. Thereafter, by ensuring that the period for which the power is to be applied is a multipIe of the half period of the power supply voltage, the time during which the triac is actually conductive is constrained to be exactly equal to the desired period (although slightly late if the zero passage detector is used directly to gate the application of control signals to the triac).

Starting from the value 320 milliseconds (which corresponds to the maximum piston admission stroke) it follows that the admission time can be varied in increments of 10 milliseconds for a power supply frequency of 50 Hz.

The following table gives all possible admission times $t_1$ in the range 320 to 160 milliseconds in increments of 10 milliseconds together with the corresponding fraction Q (as a percentage) of the maximum flow rate for each of said periods.

| | | | | | | | | | |
|---|---|---|---|---|---|---|---|---|---|
| $t_1$ | 320 | 310 | 300 | 290 | 280 | 270 | 260 | 250 | |
| Q % | 100 | 99.8 | 99 | 97.8 | 96.2 | 94.1 | 91.6 | 88.7 | |
| $t_1$ | 240 | 230 | 220 | 210 | 200 | 190 | 180 | 170 | 160 |
| Q % | 85.4 | 81.7 | 77.8 | 73.6 | 69.1 | 64.5 | 59.8 | 54.9 | 50 |

It is recalled that the required accuracy for a metering pump is ±1% of the indicated flow rate. The above table shows that this accuracy cannot be achieved for flow rates of less than 93% of the maximum flow rate. Indeed, the theoretical inaccuracy rises to about 10% when the flow rate is about 50% of the maximum. This procedure is thus not entirely satisfactory and the invention therefore proceeds by applying a correction to these values by also varying the duration (T) of the pumping cycle, i.e. the sum of the admission period, the exhaust period, and the dead period of the moving equipment in the pump.

As mentioned above, one known way of modifying the flow rate of a pump is to modify the pumping speed. When a pumping cycle (T) includes a period for which the moving equipment is at rest, as is the case when the stroke of the moving equipment is limited in the manner described above, the length of time for which the equipment remains at rest can be reduced or increased in order to reduce or increase the duration of the pumping cycle relative to the cycle duration which corresponds to the maximum piston stroke (640 milliseconds), and such modification can take place in 10 millisecond steps, for the same reasons as those already described above.

Assuming that the flow rate obtained for a cycle period of 640 milliseconds is Q, then the flow rate $Q_1$ obtained for a cycle period of X milliseconds is given by:

$$Q_1 = Q\ (640/X)$$

It is undesirable to attempt to achieve a low fraction of the maximum flow rate of the pump by excessively lengthening the pumping cycle time. If the cycle time is too long, the flow delivered by the metering pump becomes so discontinuous as to be ill-adapted to applications which require continuous metering and additional means would need to be provided for "smoothing" the flow (e.g. tanks, buffers, . . ) and the use of such means is not always desirable. Also, the maximum stroke cycle time cannot be reduced by an amount which is greater than the rest time which is made available when the piston stroke is reduced.

The way in which the cycle time (T) is selected between these two extreme values depends essentially on the way in which it is desirable for the intended flow rate to be delivered as a function of time, and that is generally dictated by the application to which the metering pump is being put.

For example, supposing that it is desired to obtain a flow rate of 75% of the maximum flow rate with an accuracy of ±1%, i.e. suppose that the theoretical flow rate must lie in the range 75.7% and 74.3%. It can be seen from the above table that this range of values cannot be achieved merely by adjusting the stroke of the piston. Several solutions for achieving the desired flow rate are possible:

1. The admission period is selected to be 160 milliseconds and the above table indicates that the flow rate for a nominal cycle time T=640 milliseconds is equal to 50% of the maximum flow rate. Assuming that the exhaust period is equal to the admission period, that leaves a rest period of 320 milliseconds. The cycle time can thus be reduced to 430 milliseconds. The theoretical flow rate obtained in this way is then 74.4% of the maximum flow rate. (Due to the technological constraint on accurately timing synchronous motor ON periods, the total cycle time, must be controlled in increments of 10 milliseconds at a power supply frequency of 50 Hz).

2. The closest value in the above table to the desired value is selected (210 milliseconds) and the cycle time is correspondingly corrected (in this case it is reduced from 640 milliseconds to 630 milliseconds). The resulting flow rate is theoretically 74.8% of the maximum flow rate.

3. The longest possible admission stroke time (320 milliseconds) is selected from the above table which leads to a requirement for the cycle time to be 850 milliseconds in order to obtain 75.3% of the maximum flow rate (or 860 milliseconds in order to obtain 74.4%).

4. Numerous intermediate solutions are also possible.

Numerous tables can therefore be established combining cycle times and admission periods for each desired partial flow rate, and the most appropriate one of such tables is selected depending on the desired nature of the flow, the nature of the fluid being metered, and other factors depending on the installation to which the metered fluid is being delivered.

The above-described method is advantageously implemented by an electronic circuit for controlling the synchronous motor and itself under the control of a microprocessor which includes a program for organizing the various switching operations to be performed by the electronic circuit as a function firstly of the available cycle time values and admission time values as previously determined experimentally or by calculation and as stored in the microprocessor memory, and secondly of the desired flow rate as expressed by means of a data input device to the microprocessor, e.g. under manual control and coupled with a device for displaying said flow rate.

Figure 2:
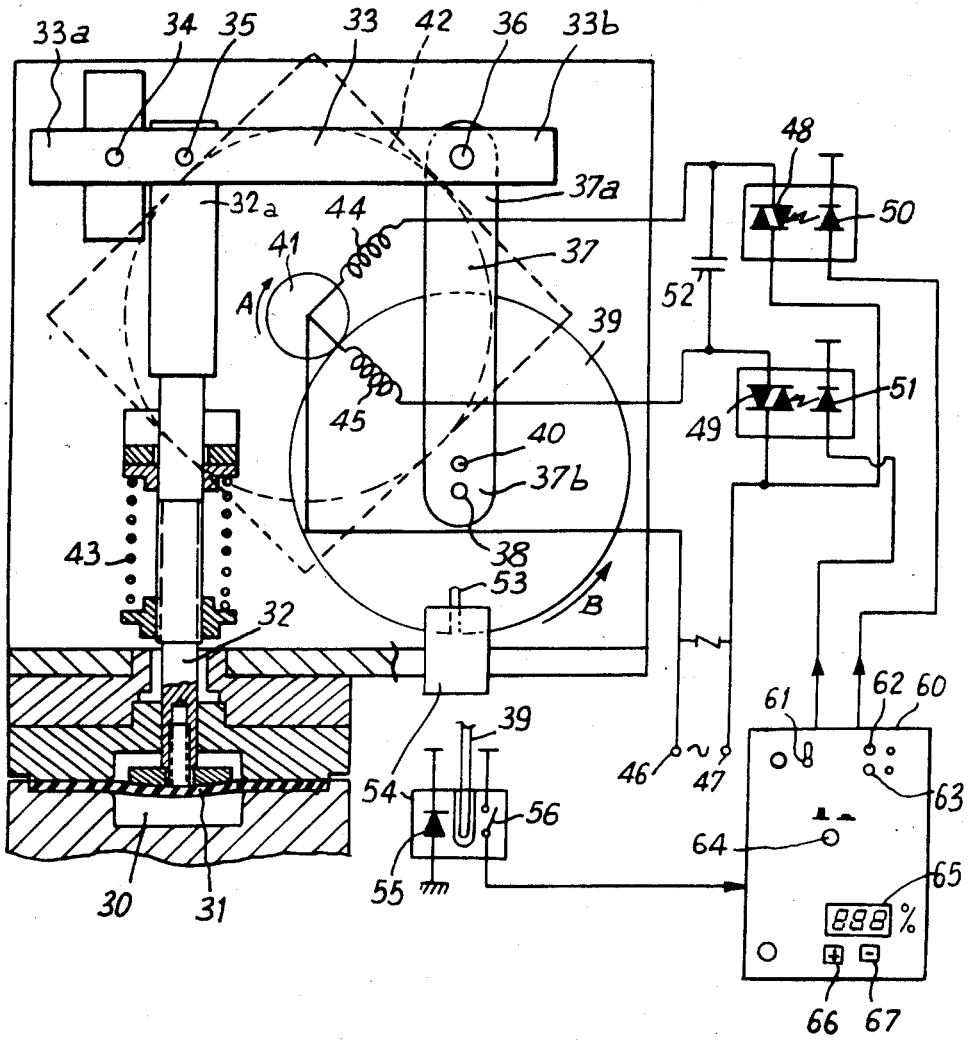
FIG. 2 is a diagram of a circuit and a device for coupling a membrane pump to a microprocessor for controlling pump operation in accordance with the invention.

FIG. 2 is a diagram of an embodiment of a metering pump which is a membrane pump and whose electronic control circuit satisfying the above criteria and is shown in greater detail.

As in FIG. 1, the pumping chamber is connected via non-return valves to an admission duct and to an exhaust duct (not shown). The pumping member is constituted by a membrane 31 which is mechanically actuated by moving equipment 32 which is driven in reciprocating rectilinear motion by a link mechanism comprising a lever 33 which is hinged at one of its ends 33 about a fixed pin 34, and which is hinged about a pin 35 to the furthest end 32*a* of the moving equipment 32 from the membrane 31, and which is hinged at its opposite end 33*b* about a pin 36 to the end 37*a* of a drive lever 37. The other end 37*b* of the drive lever 37 is hinged about a pin 38 on a wheel 39 which is rotated about a fixed shaft 40. The distance between the shaft 40 and the pin 38 constitutes the crank arm of the crank-lever system constituted by the lever 37 and the wheel 39. The wheel 39 is rotated by the output shaft 41 of a synchronous motor 42 by means of a stepdown gear (not shown) and merely indicated diagrammatically by the difference in diameter between the wheel 39 and the shaft 41.

It may be observed that this diagram shows the moving equipment in its forward dead-center position, i.e. at the end of an exhaust stroke or at the beginning of an admission stroke. The connection between the moving equipment 32 and the link mechanism is made in such a manner (as shown in the drawing) that the crank 38, 40 is in a position so that the force transmitted by the pin 38 to the lever 37 is perpendicular to the lever. This ensures that, ignoring friction, the opposing torque on starting is zero.

Also, the admission stroke of the equipment 32 takes place against the effect of a return spring 43 which is compressed during the admission stroke and which thus accumulates energy for assisting in the provision of force for the exhaust stroke, which is advantageous for a reason explained below.

44 and 45 represent two windings of the reversible synchronous motor 42 and their common point is connected to a first terminal 46 of an alternating power supply. Each of these windings is also connected to the other terminal 47 of the power supply via a respective triac 48 or 49 which is optocoupled to a respective light-emitting diode (LED) 50, 51 which constitutes the triac-controlling member. A capacitor 52 is connected in conventional manner between the two windings 44 and 45. When the triac 48 is switched on under such conditions, both windings are powered, with the winding 44 being powered by the power supply voltage and with the other winding 45 being powered by a phase-shifted voltage by virtue of the capacitor, thereby causing the shaft 41 to rotate in direction A and the wheel 39 to rotate in direction B. The direction of rotation is reversed by switching the other triac 49 on while the first triac 48 is switched off.

The LEDs 50 and 51 are connected to the microprocessor 60 which transmits control signals to them corresponding to the different power supply stages described above.

Finally, the wheel 39 may be in the form of a disk having a slot 53 which co-operates with an optical detector 54 whose function is identical to the function of the detector 20 in FIG. 1. The detector 54 is connected to the microprocessor 60 to provide the microprocessor with information concerning the presence or otherwise of the moving equipment in its origin position (forward dead center in the example shown), as indicated by the presence or otherwise of the slot 53 on the light path between an LED 55 and a light sensor 56.

The front of the microprocessor 50 may include an on/off switch 61, a first button 62 for selecting a so-called "integrated" mode of flow rate adjustment, a second button 53 for selecting a so-called "selective" mode of adjusting the flow rate by separate action on the pump's speed and its volumetric displacement, a third selection button 64 for use within the "selective" mode of adjustment to set the speed or the volumetric displacement, a display device 65 for displaying the selected value(s) and buttons 66 and 67 for determining the selected values and for varying them.

It is shown above that at least one table of values determined by the manufacturer may be stored in the microprocessor. Such tables of values may be determined by calculation when the volumetric displacement is a simple function of the rotation of the synchronous motor.

However, some pumps, such as mechanically-actuated membrane pumps as illustrated in FIG. 2, have a flow rate which is a much more complex function both of the stroke of the drive mechanism and of the pump speed, and such functions can be determined solely by experiment. Naturally, combination tables of the type described above may be established for this type of pump experimentally by measuring the flow rate effectively delivered by the pump (or by a master pump representative of the type of pump used) as a function of the displayed admission and cycle times.

When operating in integrated mode, the microprocessor stores a table of pairs of optimum values of the first period and for the cycle time corresponding to each desired value for the fraction of the flow rate (for example in steps of 2% to 100% at 1% intervals).

In this case, once the button 62 has been pressed, the buttons 66 and 67 are pressed until the desired fraction of the maximum flow rate is displayed. The microprocessor then determines the pumping cycle time and the first period (the admission period) which corresponds to the desired flow rate as a function of the data input. With the pump starting from its position shown in FIG. 2, the LED is excited for said first period to cause the wheel 39 to rotate through a certain angle. It may be observed in this respect that the motor latches onto its synchronous speed very rapidly since the opposing torque on starting is nil, given that the motor is small and therefore of low inertia. This disposition is important since it enables satisfactory accuracy to be obtained for the admission stroke, thereby enabling good accuracy to be obtained overall for the metering operation. If the synchronous motor were to latch randomly by virtue of un-controlled slip due to a non-zero starting torque of varying value, different volumes would be swept from one pump cycle to the next in spite of the first period being identical in all of the cycles.

At the end of the first period, the connection of the winding 44, 45 is reversed by exciting the LED 51 and by ceasing to excite the LED 50. In practice, this switchover is not instantaneous and allowance is made for a certain period of time between the motor ceasing to rotate in one direction and starting to rotate in the opposite direction. This time may be as much as 40 milliseconds and is taken into account when determining the stepdown ratio between the motor and the wheel of the crank-lever system. Thus, in the above numerical example, and retaining a cycle time of 640 milliseconds for the maximum pump capacity, the admission stroke will last for 280 milliseoonds as will the exhaust stroke, but the transmission ratio will be 0.285 in order to obtain a speed of rotation of 107 rpm, thus retaining the same maximum flow rate.

When the motor begins to rotate in the reverse direction the opposing torque is not zero. It therefore takes longer for the motor to latch onto its synchronous speed, but this state of affairs is unimportant since the exhaust period is not fixed a priori, but is determined by the slot 53 returning to the optical sensor 54. However, it is advantageous for the starting torque to be as low as possible, and the return spring 43 urging the moving equipment towards its forward dead-center position serves to reduce said starting torque.

When the optical detector 54 sends a signal to the microprocessor, the microprocessor turns off the LEDs 50 and 51 and the motor remains unpowered until the full cycle time has elapsed. The same sequence of operations is then repeated for the next cycle, and so on.

When operating in "selective" mode, the microprocessor stores a first table of values of the first period (the admission period) in multiples of the half period of the power supply for various possible desired flow rate fractions, for example in 5% intervals, and a second table likewise established as a function of the desired flow rate fraction, giving the closest value for the cycle time in half period multiples. Thus, by pressing the button 63, the microprocessor is placed in a situation where it uses one or other of said tables. By pressing the button 64 the microprocessor is instructed to act on the flow rate solely by acting on the admission stroke period. The buttons 66 and 67 are used to select the appropriate 5% range, thereby causing the microprocessor to use the corresponding value from the first table so that the installation operates as described above with the cycle time being kept constant to the cycle time which corresponds to its maximum capacity. Otherwise, if the button 4 is not held down, the flow rate is modified by adjusting the cycle time (i.e. the pump speed). The appropriate cycle time is then taken from the second table as a function of the displayed fraction of maximum flow rate.

Although less accurate than integrated adjustment mode, there are some applications for which selective adjustment mode may suffice.

A metering pump equipped in this manner may be provided in a version which gives integrated adjustment only, or in a version which gives selective adjustment only. All three possible versions differ only in the electronics of the microprocessor, in other words the differences lie in the memories and the circuits for selecting them. This pump design is therefore suitable for highly standardized manufacture. A fourth version (not shown) consists in a pump for which manual adjustment of the desired flow rate fraction is replaced by a signal which servocontrols said flow rate on an external parameter (for example the flow rate of the fluid into which the metered liquid is to be injected). Here too, the basic components of the fourth version remain standard with the other versions. The only change lies in the way in which the desired flow rate signal is applied to the microprocessor.

Finally, the microprocessor program may also use one or more pre-established subprograms for making corrections to the stored values (whether they be experimental or calculated) as a function of special conditions applicable to pump operation (viscosity of the admitted fluid, pressure conditions on admission and on exhaust, inertia of the motor and of the moving equipment, changes in membrane behavior, changes in the type of pump controlled, supposing the microprocessor is designed to control a battery of different pumps either simultaneously or in succession, . . . ).

The facade of the microprocessor 60 as described with reference to FIG. 2 may be made in various ways. By way of an example which is not shown, mention may be made of a version in which the buttons 62, 63, and 64 for selecting the mode of adjustment are brought together in the form of a single button which co-operates with internal circuits for performing the selection. Thus, for example, one stroke on the single button puts the microprocessor into "integrated" mode, a second stroke puts it into "cycle time" mode, a third stroke puts it into "stroke" mode, and a fourth stroke may return to "integrated" mode. In such an embodiment it would be advantageous for the display device 65 to include space for displaying a mark identifying the currently selected mode.

We claim:

1. A method of accurately setting the flow rate of a variable-flow metering pump, said setting being expressed as a fraction of the pump's maximum flow rate, and said pump including a pumping member coupled to a transmission element driven with a rectilinear reciprocating motion and creating a direct and positive link between said pumping member and a reversible synchronous electric motor which is powered by AC at fixed frequency, said method consisting in using a microprocessor to control the power supply to the drive motor for each pump cycle in accordance with the following steps:

a first step in which the power is applied to the motor to rotate it in a first direction and in which said power is maintained for a first period of time determined from a fixed predetermined origin position of the moving equipment in the pump;

a second step in which the power applied to the motor at the end of said first period of time is switched to reverse the direction in which the motor rotates, and in which said reverse power is maintained for a period of time equal to that required by the moving equipment of the pump to return to its origin position;

a third step in which the power supply to the motor is turned off at the end of said second period of time and in which the power is maintained off for a third period of time corresponding to the difference between the sum of said first and second periods of time and a pumping cycle time which is not less than said sum:

said first period of time and said cycle time being selected by the microprocessor as a function of the desired fraction of the maximum flow rate as indicated to the microprocessor, and being selected from a plurality of time values stored in the microprocessor memory and each equal to an integer multiple of one half of the period of the AC power supply.

2. A method according to claim 1, wherein only the said cycle time is selected by the microprocessor as a function of the desired flow rate fraction, with said first period remaining constant.

3. A method according to claim 1, wherein only said first period is selected by the microprocessor as a function of the desired flow rate fraction, with the cycle time remaining constant.

4. A method according to claim 1, wherein the pumping member is a piston driven in sinusoidal motion and wherein the stored values for said first period and said cycle time are determined by calculation.

5. A method according to claim 1, wherein the flow rate of the pump is a complex function of the motion of the motor due to the nature of the drive chain connecting said motor to the pumping member and to the nature of the pumping member (if a membrane), and the said stored values are determined experimentally.

6. A method according to claim 1, wherein the origin position of the moving equipment of the pump is detected by a detector whose output signal is used by the microprocessor.

7. A pump applying the method according to claim 1, and comprising: a pumping member; moving equipment for driving said pumping member; said moving equipment being driven to perform reciprocating rectilinear motion by means of a transmission device coupled to a motor, said motor being a reversible synchronous motor with each of its windings connected to a source of AC power at fixed frequency via a triac which is optocoupled to a controlling light emitting diode (LED) which is itself connected to the output from a microprocessor for controlling the application of AC power to said windings, and a detector for detecting when said moving equipment is in its origin position, said detector being connected to an input of said microprocessor.

8. A pump according to claim 7, wherein the transmission for transmitting the motor drive to the moving equipment is such that, ignoring friction, in the origin position of the moving equipment the torque opposing the transmission of said motion is nil.

9. A pump according to claim 7, wherein a resilient return member is coupled to the moving equipment in order to return it towards its origin position.

10. A pump according to claim 7, wherein the microprocessor includes a display device for displaying the desired flow rate to which the pump is set.

* * * * *